US005628075A

United States Patent [19]

Dudnik et al.

[11] Patent Number: 5,628,075

[45] Date of Patent: May 13, 1997

[54] PORTABLE VERTICALLY ADJUSTABLE LAVATORY ASSEMBLY

[76] Inventors: George Dudnik, 41 Byron Dr., Pleasant Hill, Calif. 94523; Yana Doppelt, 1895 Jackson St., No. 706, San Francisco, Calif. 94109

[21] Appl. No.: 393,854

[22] Filed: Feb. 24, 1995

[51] Int. Cl.[6] ..... E03C 1/324

[52] U.S. Cl. ..... 4/645

[58] Field of Search ..... 4/645

[56] References Cited

U.S. PATENT DOCUMENTS 3,486,175 12/1969 Schwartz ..... 4/645

5,230,109 7/1993 Zaccai et al. ..... 4/645

FOREIGN PATENT DOCUMENTS 8702728 5/1987 WIPO ..... 4/645

*Primary Examiner*—Charles E. Phillips

*Attorney, Agent, or Firm*—Benman Collins & Sawyer

[57] ABSTRACT

A portable vertically adjustable lavatory assembly includes a box member. Inside the box member is a vertically movable platform positioned and has a lavatory connected thereto. A lavatory is positioned outside of the box member and includes a sink portion having an outlet opening thereto. A drain line is in fluid flow communication with an outlet of the sink and a sewer line and is adapted to accommodate changes in height of the sink member. The box member can be attached directly to the wall member, thereby minimizing modification of the wall or the like. The lavatory can also include a system for pumping waste water out of the sink when the drain line is below the sink and/or sewer line.

8 Claims, 10 Drawing Sheets

FIG. 2A
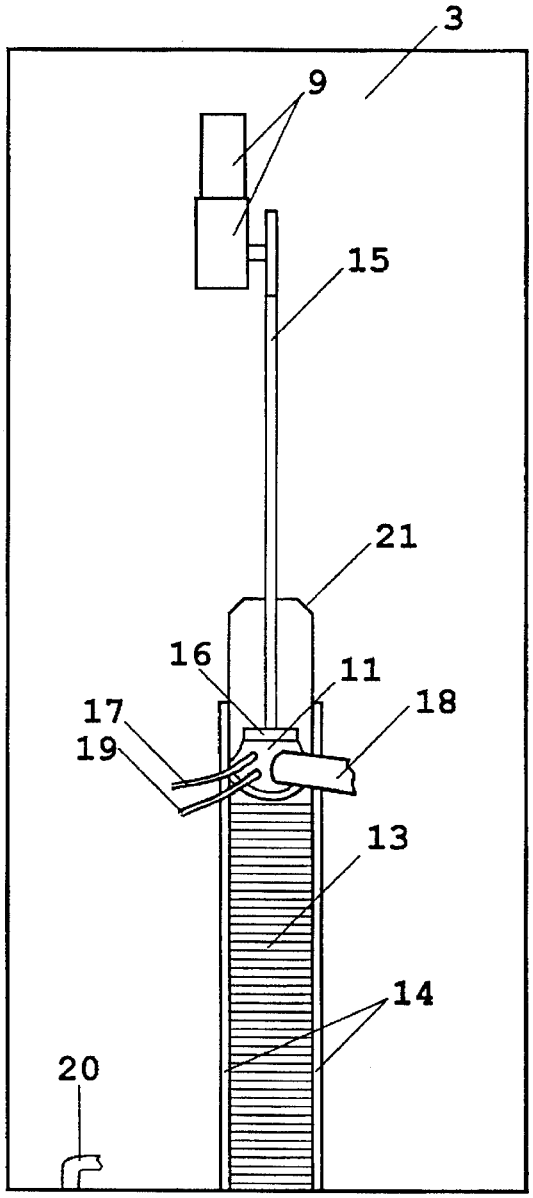
FIG. 2B
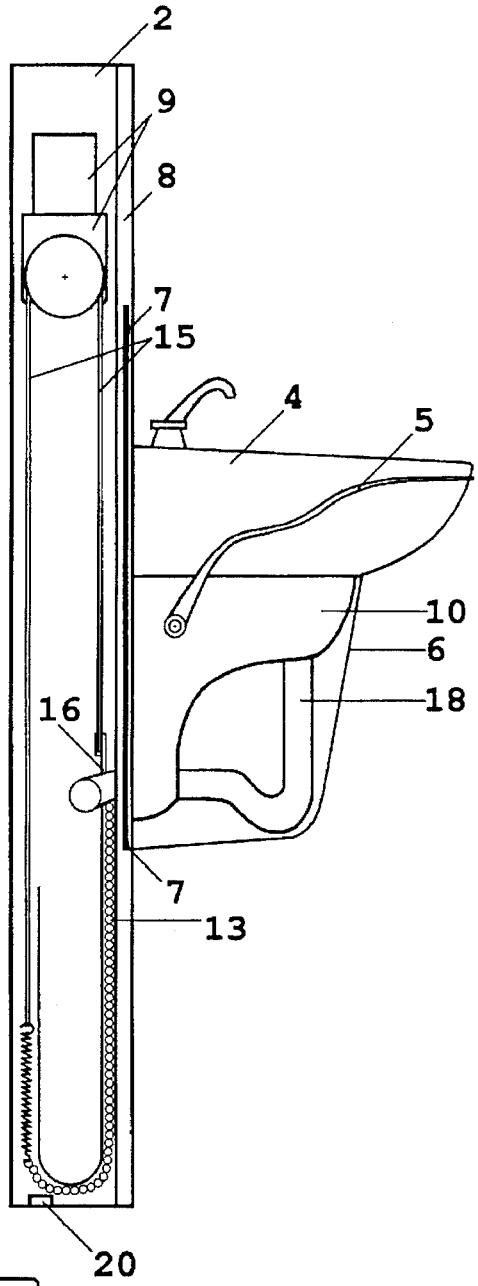
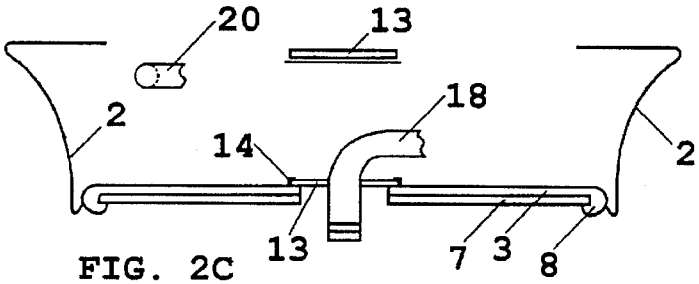
FIG. 2C

FIG. 3A
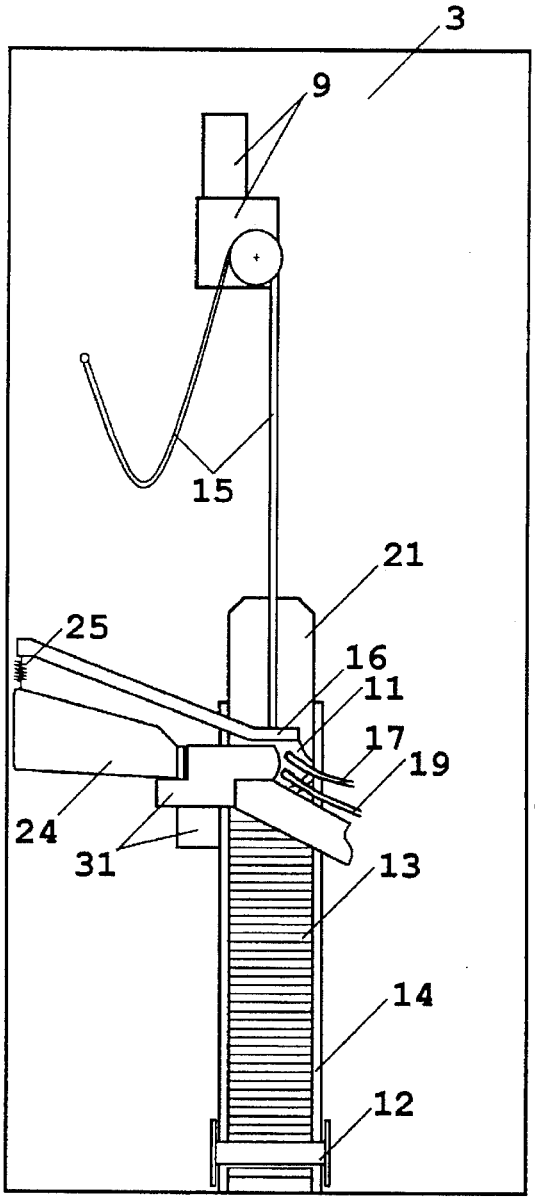
FIG. 3B
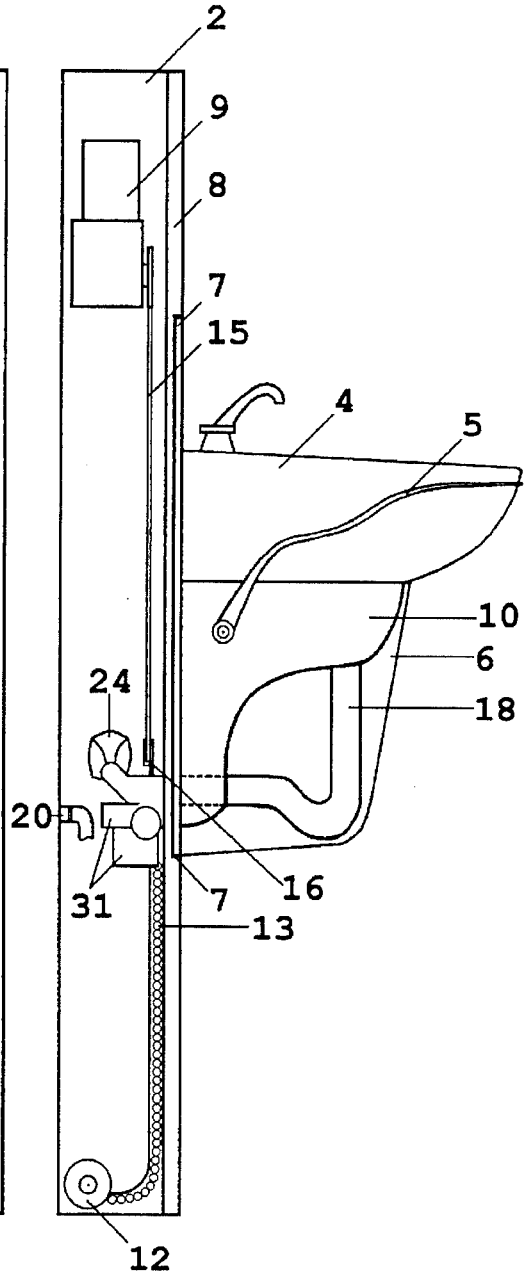
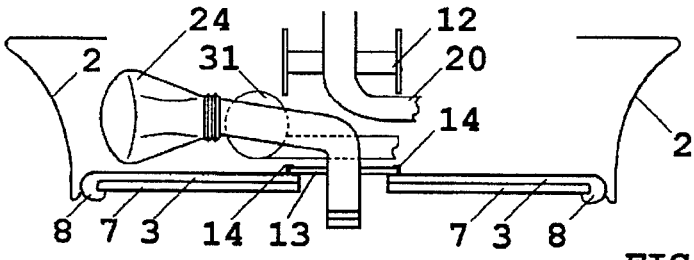
FIG. 3C

PORTABLE VERTICALLY ADJUSTABLE LAVATORY ASSEMBLY

FIELD OF THE INVENTION

The present invention is directed toward vertically adjustable lavatories and more particularly to a portable vertically adjustable lavatory.

BACKGROUND OF THE INVENTION

A vertically adjustable lavatory is desirable to allow convenient use by people of various heights, and is especially convenient for wheelchair users who must sit while using the lavatory and for children of age 3 and older. Furthermore, small children may risk falling from a device such as a stool when boosting themselves up to the height of a conventional lavatory. In the past, some lavatories have been designed to be vertically adjustable by hand operated jacks, hydraulic pressure, electric motors, and/or various other types of mechanical devices, gears, and linkages. Typically, the drain lines of these systems are flexible or telescoping to accommodate for the vertical movement of the sink. Vertically adjustable lavatories of this type are disclosed in U.S. Pat. Nos. 1,060,106 (McGregor), 1,391,091 (Arbuckle), 2,716,757 (Erickson), 2,817,094 (Lessley), 3,011,177 (Haughhey), 3,118,147 (Larkin), 3,456,264 (Flagg), 3,473,173 (Maciulaitis), 3,486,175 (Schwartz), 3,502,384 (Gipson), 4,233,693 (Stocklow) and 5,230,109 (Zaccai).

Gipson discloses a sink which is slidably mounted between a pair of cabinets. A chair is positioned underneath the sink to provide a seat for using the sink in a lowered position.

Schwartz discloses a height adjustable washbasin that is slidably mounted by two pairs of rollers to a pair of channel-shaped tracks which are secured within a wall to studs or the like. One embodiment of the Schwartz apparatus shows a basin mounted to a telescoping track and slide assembly including slides disposed in channel-shaped intermediate sliding tracks which, in turn, are slidably disposed in channel-shaped fixed tracks. The lavatory in Schwartz may be elevated either hydraulically or electrically.

In U.S. Pat. No. 3,118,147, a mounting plate is attached to a wall and has inwardly facing tracks at opposite sides thereof. A sink support structure having outwardly facing tracks and an L-shaped bracket slides vertically on rollers positioned between the tracks. A rear edge of a sink support structure such that the sink moves vertically with the sink support structure.

Lessley discloses a vertically adjustable lavatory including a frame received within a recess in a wall. The lavatory is supported on a pair of brackets which are mounted to threaded elevating screw elements such that the lavatory is height adjustable relative to the frame.

In U.S. Pat. No. 3,473,173, a height adjustable lavatory includes a pair of shafts extending vertically from the base of the frame, a cantilevered arm assembly including a table and basin mounted to the arm assembly, and an upright cabinet assembly mounted to the base cabinet assembly. The upper cabinet assembly, which can include a mirrored medicine cabinet or the like, is also mounted to the arm assembly by a vertical sub-frame such that both the upper and base cabinet assembly are vertically adjustable in unison. A telescoping skirt assembly is connected to the base cabinet assembly and the base of the frame to provide an enclosure which expands and contracts in response to the vertical movement of the lavatory. The lavatory may be height adjustable either hydraulically or electrically, and a flexible hose coupling is provided to accommodate for the vertical movement of the basin.

U.S. Pat. No. 5,230,109 is directed to a vertically adjustable lavatory assembly including a carrier frame positioned within an outer frame. The carrier frame is vertically moveable within the outer frame and has a lavatory connected thereto. The lavatory is positioned substantially outside the carrier frame and outer frame, and includes a faucet and a sink basin having an outlet opening therein. The vertically adjustable lavatory assembly includes means for vertically moving and guiding the carrier frame within the outer frame. A drain line is in fluid flow communication with the sink basin outlet opening and a sewer line, and is adapted to accommodate for changes in the height of the basin.

All of the above-identified adjustable lavatories require a major modification of an existing structure to facilitate their use. In addition, in known adjustable lavatories, if the waste water can not drain by gravity the lavatory can become inoperable. Finally, known vertical adjustable lavatories do not include any mechanism to provide protection in the event that the drain line becomes clogged or the like. Accordingly, what is needed is an adjustable lavatory that is portable and that addresses the above described problems. The present invention addresses such a need.

SUMMARY OF THE INVENTION

A portable vertically adjustable lavatory assembly is disclosed in accordance with the present invention. The portable vertically adjustable lavatory including a sink is mounted to a mobile platform. The mobile platform moves along vertical guides. The platform and the driving mechanism, which is located in a box member, are connected by a bracket through a service window. The water lines of the sink are also provided through the service window. The service window is covered by a movable screen. The movable screen accompanies the platform movement and prevents undesirable access inside the box, creating a solid obstacle.

The portable vertically adjustable lavatory in accordance with the present invention can be installed without reinstalling the sewage branch-pipe. In a first simplified embodiment of the lavatory, a pumping-out system is not employed. However, this aspect will require an installation of the drain line in a floor or in a wall close to floor level.

In a second embodiment of the present invention, a system is provided which is utilized when the sink drain line is at a height below the sewage line. This pumping system detects whether waste water is accumulating in the sink drain pipe and whether the sewage line is clogged. If the waste water is above a certain level in the sink drain pipe, a pump will force water out of the sink drain pipe. If the water level reaches the critical (emergency) level, the pumping system also includes means for preventing water from entering the faucet from the service lines.

The advantages of a portable vertically adjustable lavatory in accordance with the present invention includes the following:

- safety of the operation;
- ease and simplicity of the control of operation;
- ease and simplicity of its installation (none or very minor construction work needed);
- economical efficiency (low energy consumption);
- an elegant appearance.

The lavatory also provides a variety of opportunities for its appearance variation by means of various decorative attachments mounting, use of variety of colors and/or materials (metal, plastic, ceramic, mirror, wood) for the easy match (or contrasting) of the lavatories with the existing decor of a lavatory or bathroom.

The first embodiment of the invention has an electrical drive mechanism. The automatic pump-out system is not foreseen in the first embodiment of a portable lavatory.

Figure 2D:
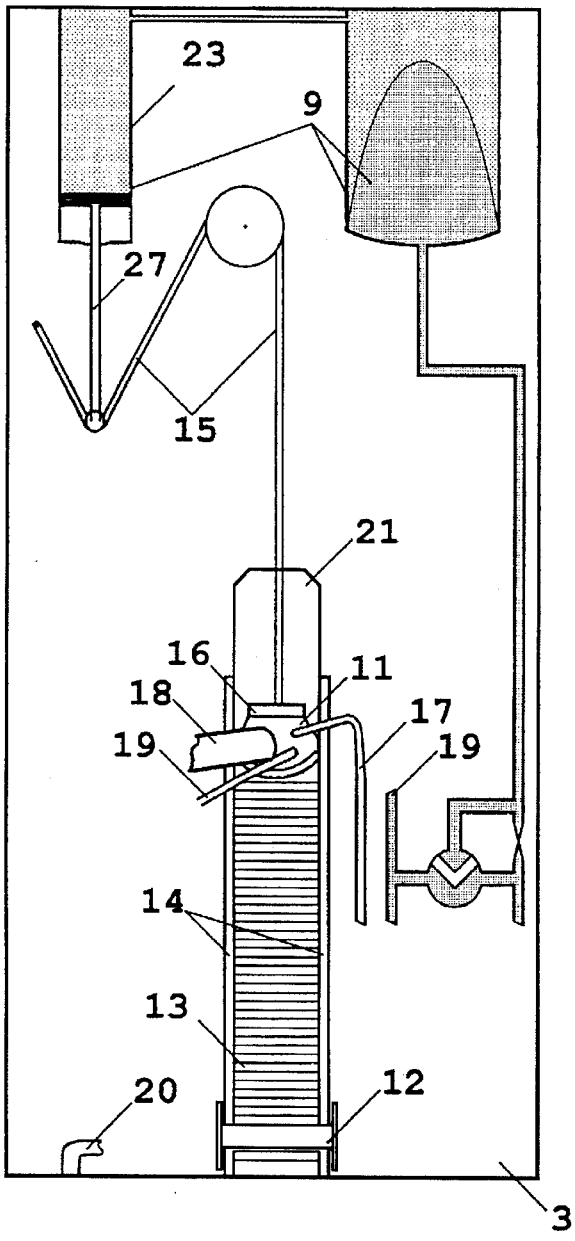
FIGS. 2A, 2B and 2C are respectively rear, side and horizontal cross-section views of a first embodiment of a portable lavatory in accordance with the present invention.
Figure 2E:
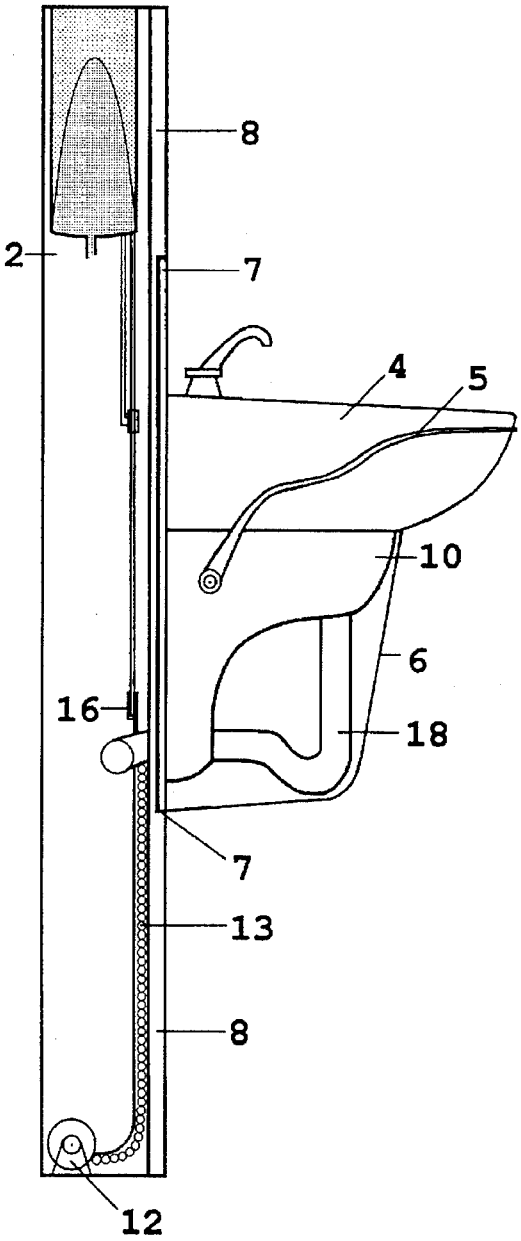

FIGS. 2D and 2E are respectively rear and side cross-sectional views of another embodiment of a portable lavatory in accordance with the present invention.

FIGS. 3A, 3B and 3C are respectively rear, side and a horizontal cross-section view of a second embodiment of the present invention. The second embodiment of the invention is completed with an automatic pump-out system.

Figure 4:
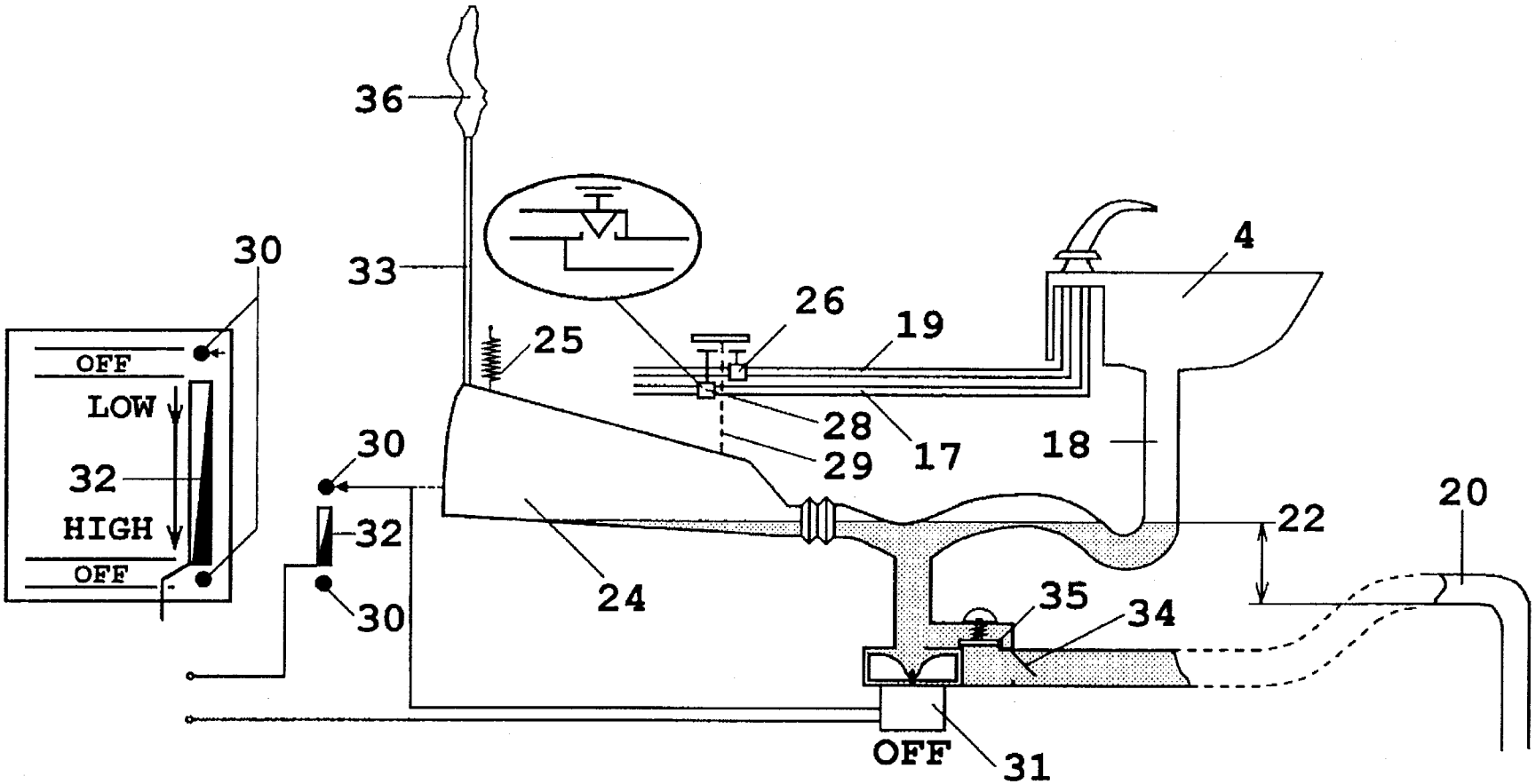

FIG. 4 is a principal diagram of the lavatory automatic system's state in the condition when waste water drains by gravity.

Figure 5:
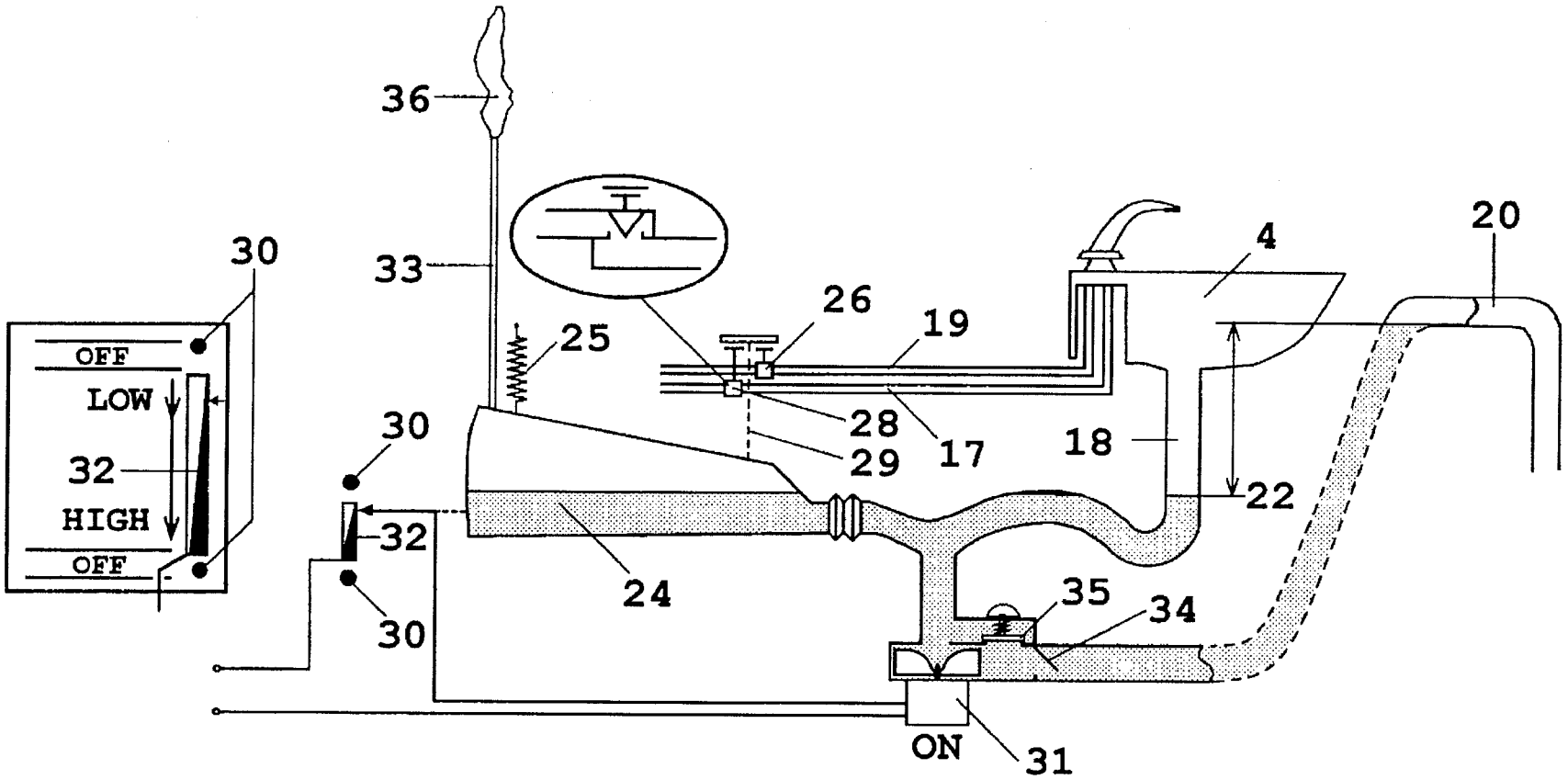

FIG. 5 is a principal diagram of the lavatory automatic system's state in accordance with the present invention when waste water drain by gravity is impossible.

Figure 6:
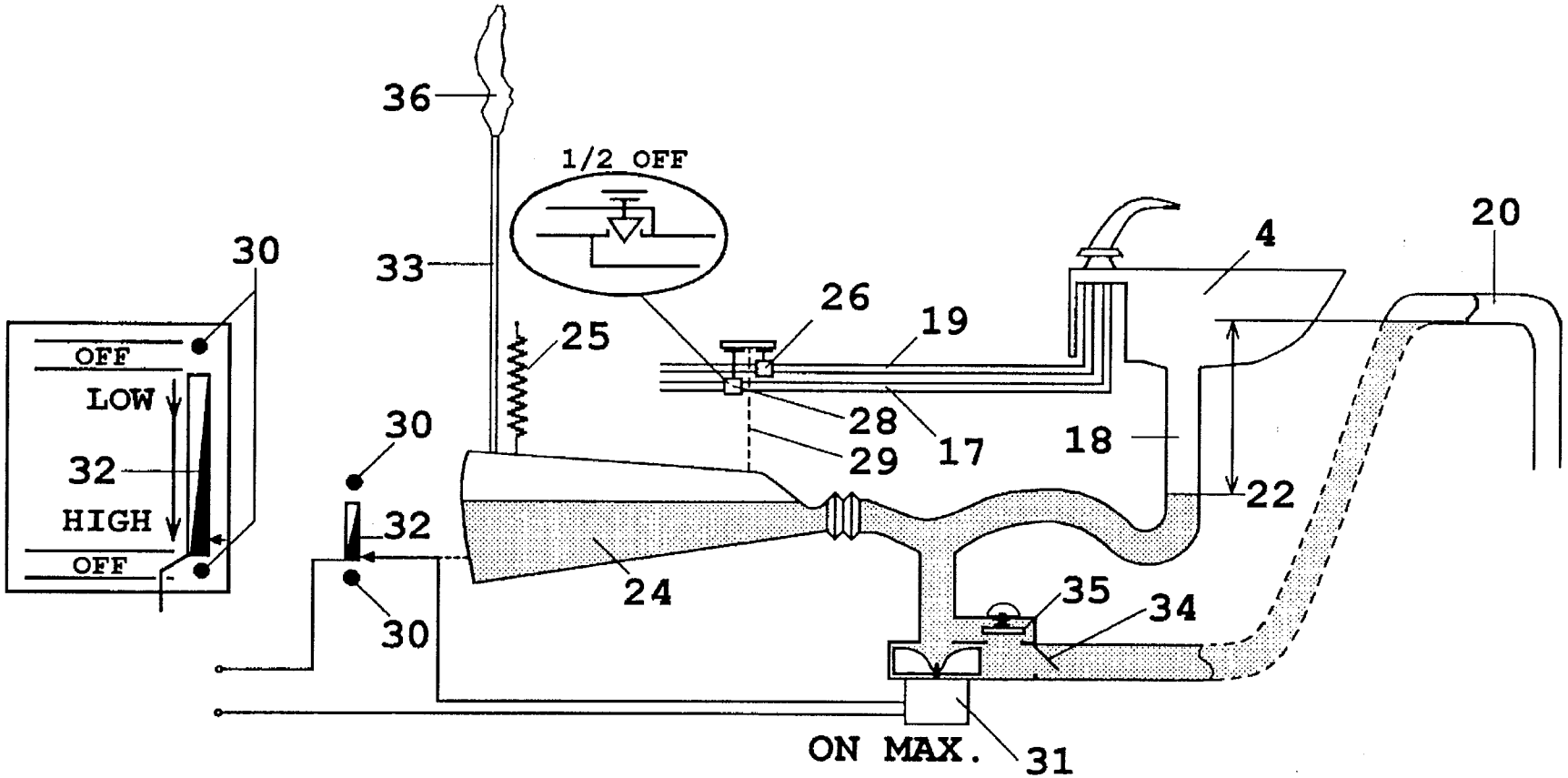

FIG. 6 is a principal diagram which shows the lavatory automatic system's state in a first emergency situation.

Figure 7:
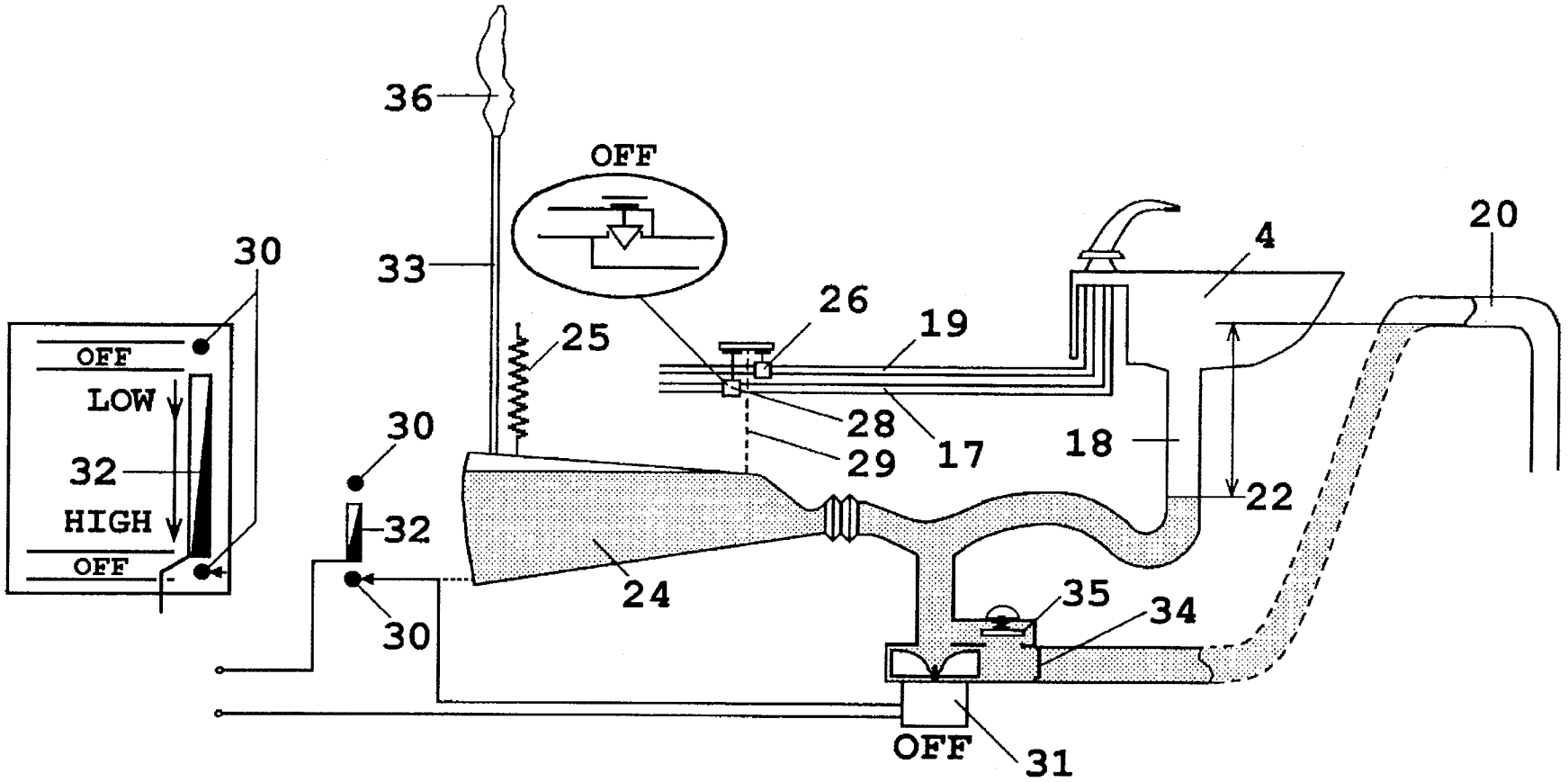

FIG. 7 is a principal diagram which shows the lavatory automatic system's state in a second emergency situation.

Figure 8:
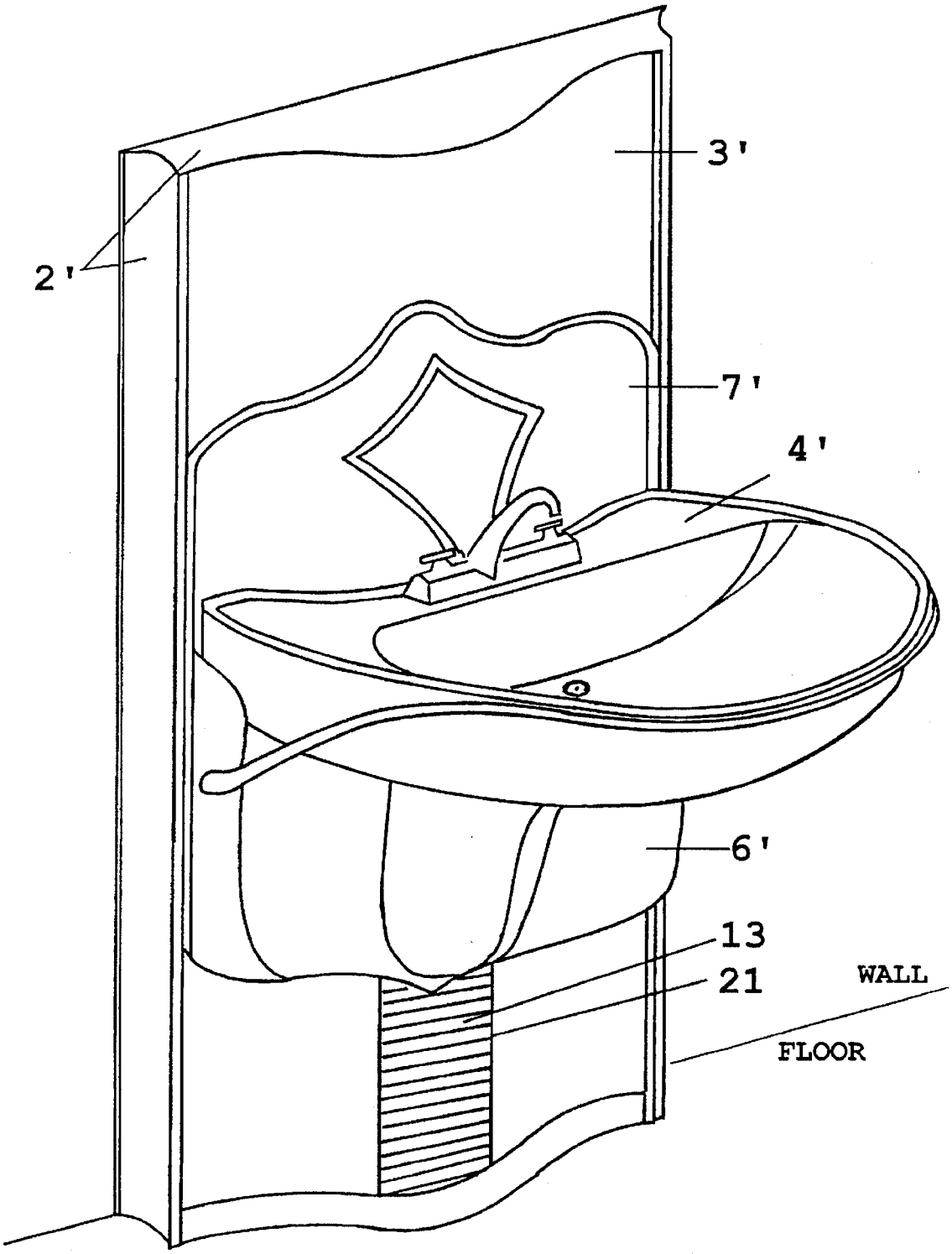

FIG. 8 is a perspective view of a second embodiment of a portable lavatory in accordance with the present invention.

Figure 9:
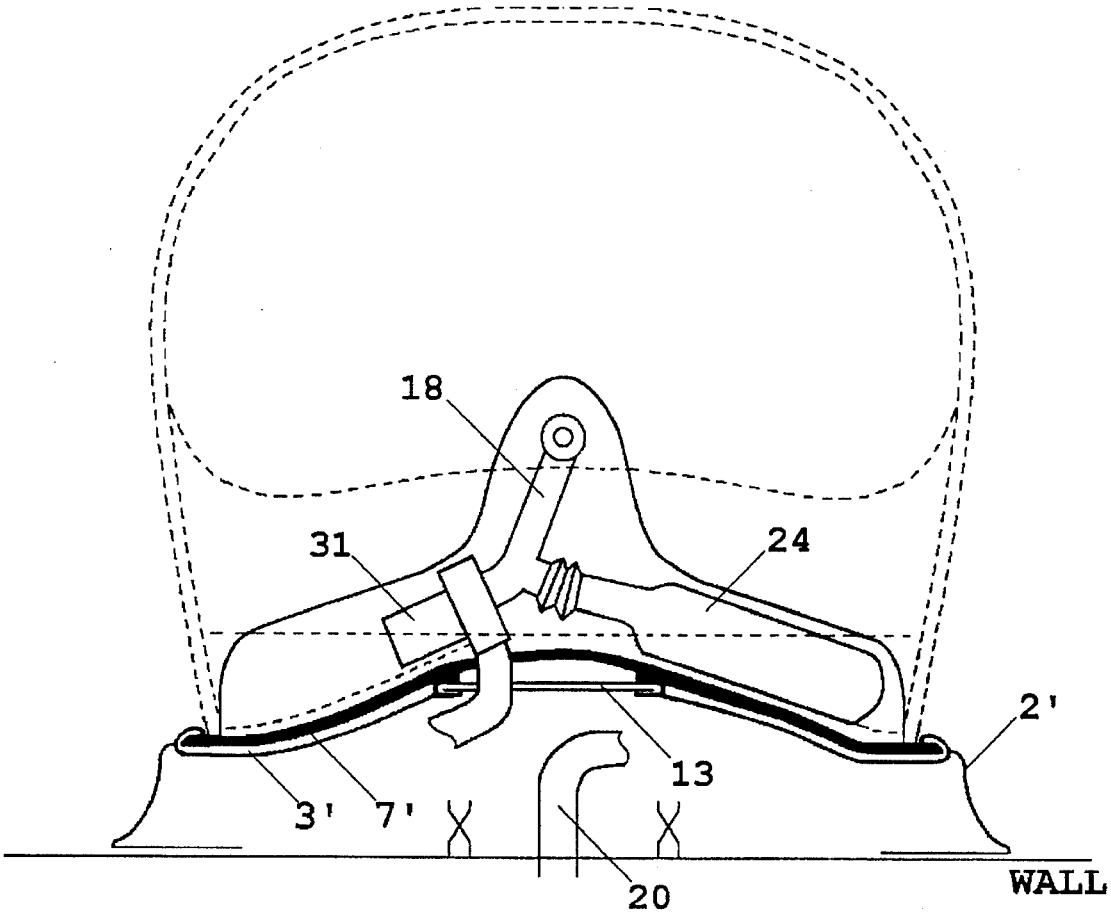

FIG. 9 is a horizontal cross-sectional view of the portable lavatory of FIG. 8.

DETAILED DESCRIPTION OF THE DRAWINGS

The present invention relates to an improvement in adjustable lavatories associated with known adjustable lavatory. The following description is presented to enable one of ordinary skill in the art to make and use the invention as provided in the context of a particular application and its requirements. Various modifications to the preferred embodiments will be readily apparent to those skilled in the art, and the generic principles defined here may be applied to other embodiments. Thus, the present invention is not intended to be limited to the embodiments shown, but is to be accorded the widest scope consistent with the principles and novel features disclosed herein.

Figure 1:
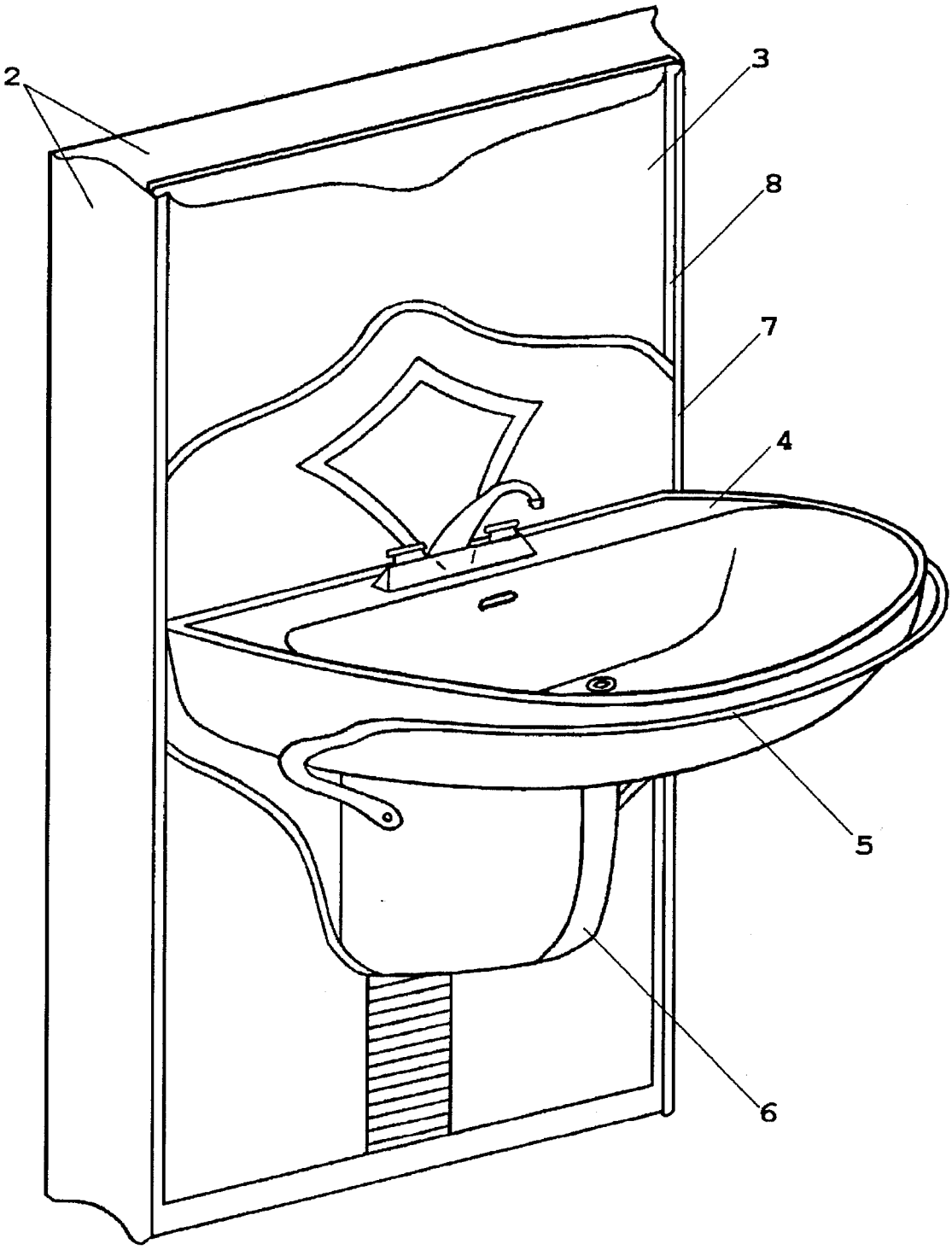
FIG. 1 is a perspective view of a first embodiment of a portable lavatory in accordance with the present invention.

Referring now to FIG. 1, what is shown is a perspective view of a first embodiment of a portable vertically adjustable lavatory 1 in accordance with the present invention. The height of the lavatory sink 4 above the floor is controlled to ensure equally comfortable conditions for people of various height.

In a preferred embodiment, the range of movement of the sink 4 upper edge is from 18" to 36", while the standard fixed level is 32". In a preferred embodiment, the approximate time required to move the sink 4 between the range limits (18" to 36") is about three seconds (if electronically driven) and about 10–12 seconds (if hydraulically driven). The sink 4 may be stopped at any height within the 18"–36" interval.

Referring first to FIGS. 2A, 2B and 2C, what is shown are rear, side and sectional views of an embodiment of the portable lavatory 1 in accordance with the present invention. In this embodiment, the motor drive 9 is electro-mechanical. In another embodiment shown in FIGS. 2D and 2E, the motor drive 9 is hydraulic. It should be understood by one of ordinary skill in the art that the movement drive can be a variety of types and their use would be within the spirit and scope of the present invention.

Referring back to FIGS. 2A and 2B, the lavatory 1 is typically rectangular in shape and includes a box 2. The rectangular box 2 can then be attached directly to a wall or the like with little or no modification to the existing architecture. Vertical parallel guides 8 are mounted on a front panel 3 of the rectangular box 2.

The lavatory sink 4 is mounted to a mobile platform 7, which moves along those vertical guides 8. The platform 7 and the motor drive 9, which is located in the box 2, are directly connected by a drive chain 15 and bracket 16 through the service window 11 and the front panel window 21. In this embodiment, the service lines 17, 18 and 19 of the sink 4 run through this service window 11 and the front panel window 21. The front panel window 21 is covered by a movable screen 13. This screen 13 accompanies the platform movement and prevents undesirable access inside the rectangular box 2, creating a solid obstacle. The design of the front panel window 21 allows for service access inside the box either from the left or from the right, whatever is more convenient.

The motor drive 9 is controlled by a handle 5, girdling the front and, partially, the sides of the sink 4. The handle 5 has a fixed neutral position. In this position, the motor drive 9 is self-hindered.

In the handle "UP" position, the movement drive 9 is turned ON (or water from the water line is fed to the hydraulic drive as shown in FIGS. 2D and 2E) and the platform 7 with the sink moves up. In the handle "DOWN" position, the drive's 9 reversing gears is turned ON (or water from the hydraulic system 9 is discharging into the drain as shown in FIGS. 2D and 2E), and the platform with the sink 4 moves down due to gravity.

The free end of the movable screen 13 moves up along the back wall of the box, bending around the sleds, and connects with the free end of the drive (gear) chain 15 through the stretching spring 40. This version of the lavatory 1 requires a sewer branch-pipe to be located below the sink drain pipe. The branch-pipe of the sewer lines may be located in any area in a floor or on a wall to the right or to the left of the screen, but not higher than 4" from the floor (on a branch-pipe center). If the sewerage branch-pipe installation into the above mentioned areas is not a problem (for example, a house is under construction or repair/remodeling, etc.) this type of portable lavatory 1 is preferable. The water lines (not shown) under the sink 4 are covered in a preferred embodiment by a safety and decorative jacket 6 (FIG. 1).

As has been above-described, one of the problems with known adjustable lavatories is that if the sink drain line is below the sewer line, the waste water will not adequately drain out of the sink. In addition, another problem with known adjustable lavatories is that if the sewer line becomes clogged or the like, there is no effective way to ensure that the sink does not overflow with waste water or the like. The known adjustable lavatories require compulsory installation of the sewer branch-pipe below a sink drain pipe.

Applicants have developed a pumping system for minimizing the above-identified problems utilizing a unique automated system of waste water pump-out in a preferred embodiment. This system automatically turns ON and automatically selects the mode of the pump-out operation or halts operation of the sink. This embodiment of the device applies to the situation where drain of the waste water by gravity is impossible. To particularly describe the advantages of this type of system, refer now to the following paragraphs.

Portable Lavatory 1 with Pump Automatics 37

In a preferred embodiment of the portable vertically adjustable lavatory (FIGS. 3A, 3B and 3C), the free end of a movable screen 13, is reeled up on a wind-up drum 12. This allows for a maximum amount of free space near the back wall of the box 2. This preferred embodiment of the lavatory does not require a relocation of the sewerage branch-pipe, and its installation does not represent a difficulty. However, the existing service lines should not be in the way of the device movable parts (for example, to bulge far out from a wall, etc.). If this condition is satisfied, the installation of our device does not represent any complexity or difficulty. In this case all that is needed is to secure the device on a wall through screws or the like and to connect the service lines.

FIGS. 4–7 represent the disposition of the main parts and units of the automatic pump-out system 37 and their operation when the waste water drains by gravity (FIG. 4), when the waste water cannot drain by gravity (FIG. 5), and first and second emergency situations (FIGS. 6 and 7).

Waste Water Drains by Gravity (FIG. 4)

Waste water drains by gravity when the sink drainage pipe 18 is higher than the sewerage entry 20, and the drain water level 22 is higher than the sewerage entry 20. Accumulating tank 24 is empty. Waste water drains to a sewer bypassing the tank 24. The end of the tank 24 is lifted. The suspension spring 25 is compressed. Emergency valves 26 and 28 of the cold and hot water lines 17 and 19 are opened. Those valves 26 and 28 have a mechanical connection 29 with the tank 24. The water drains by the gravity. Switch 30 and the regulator 32 of the operation of the pump 31 is in the "OFF" position. The air duct loop 33 connects the tank 24 with a soft air bag 36. The tank 24 lets out and takes on air through air duct loop to and from the air bag 36.

Waste Water Drain by Gravity is Impossible (FIG. 5)

This is the case when the sink drainage pipe 18 is lower than the sewerage entry 20. Tank 24 begins to lower in its back part under the weight of the accumulating water, and the suspension spring 25 begins to stretch. The switch 30 activates, and "SWITCHES ON" the pump 31. The regulator 32 of the pump 31 revolution is in direct proportion to the fall of the tank 24 (angle of the tank). The more the waste water comes into the tank 24, the more the angle of the tank 24 inclination and the higher the pump 31 revolution.

The system is self regulating. In a preferred embodiment, at the highest revolutions, the pump 31 productivity is 2–2.5 times greater the maximum possible volume of water, which the sink drainage pipe 18 able to pass. Because of the pump 31 productivity, at any time the accumulating tank 24 can only be partially filled unless an emergency situation occurs. If the inlet of waste water stops, the tank 24 empties by a pump and takes a position as shown in FIG. 4. The pump 31 will then switch OFF. The lobe valve 34 will close under the reverse water flow from the sewer pipe. The tank 24 will become almost entirely filled only in cases of emergency situations, foreseen by the operation modes shown in FIGS. 6 and 7.

First Emergency Situation (FIG. 6)

Emergency situation happens when:

1. A house sewerage is clogged-up.
2. Electrical power black-out (interruption).
3. The pump-out system is broken.

In any of those situations, the accumulating tank 24 fills-up to ⅔–¾ of its capacity, and accordingly, its weight increases. The regulator 32 of the pump revolutions switches ON the pump 31 to its maximal productivity. The emergency valves 26 and 28 become partially closed down. If the waste water pumping-out is hindered (the sewerage system is partially clogged), the safety valve 35 activated. Pump outlet is then connected to its inlet, thereby protecting the pump motor 31 from being overloaded. Pressure at the pump outlet is maintained at the calculated level due to the spring resistance of a safety valve 35.

Second Emergency Situation (FIG. 7)

If the tank 24 continues to fill-up by the water from the sink 4 and then becomes substantially completely filled-up, then, under the weight of the filled-up tank:

1. The emergency valves 26 and 28 on the lines of cold and hot water are shut off, thus preventing water to flow to the sink faucets (analogously to water supply system to the toilet tank);
2. The regulator 32 turns to the "SWITCHED OFF" position and the pump 31 stops operating.

Restoring the System's Operability after Emergency Situation

To restore the system's operability, i.e. waste-water-pumping-out after the emergency situations, the operation shown in FIGS. 6 and 7 does not present any difficulty. When the sewerage system is cleaned-up or electrical power restored, it is enough to lift the sink 4 by handle 5 to a high up when it drains by the gravity (FIG. 4). The water will run-off to the sewerage and the accumulating tank 24 will be restored to its original position as shown in FIG. 4. The sink 4 has to be lifted up by switching the gear to the "UP" position using the control handle 5 (FIG. 1). When the tank 24 is empty, emergency valves 26 and 28 are opened-up.

Although the present invention has been described in accordance with the embodiments shown in the figures, one of ordinary skill in the art recognizes there could be variations to the embodiments and those variations would be within the spirit and scope of the present invention. For example, it should be understood that the pump automatics 37 can be situated not only on the box, but also on the mobile platform 7 on the outside i.e. under the jacket. Referring now to FIG. 8, what is shown is another embodiment of the portable lavatory 1' which would have the pump automatics on the outside. By including the pump, only slightly changes the form of the decorative jacket 6' to accommodate the pump automatics. In placing the pump automatics on the outside of the box area, lavatory is even more "user friendly" in that the entire box including the pump automatics 37 and sink can be attached to the wall.

The lavatory 1' includes a model with a convex (or undulating) front panel 3' and with corresponding convex (or undulating) mobile platform 7' is shown in FIG. 8 (general view) and in FIG. 9 (horizontal cross-sectional view on a level of communications).

The convex or undulating front panel 3' allows for a reduction in depth of the lavatory 1', on sides and the increase in depth in the central part where the existing communication lines enter the box. This modification simplifies the device installation. In addition, the convex shape of the front panel 3' makes its appearance even more elegant. The pump-out automatics 37 in this model is located (installed) on the mobile platform 7' under the sink 4' and is covered by the security jacket 6' of the accordingly modified shape.

The pump-out automatics 37 are separated from the flexible communication lines by the front panel. It helps to avoid the accidental contacts of the automatics 37 with the flexible communication lines and significantly increases the reliability of the system. This lavatory 1' will also have a sink 4' of a special shape in order to match a convex or undulating mobile platform 7'. The installation of a standard sink 4' (with a straight back wall) on a convex/undulating surface of the mobile platform 7' is also possible by means of matching brackets.

Accordingly, many modifications may be made by one of ordinary skill in the art without departing from the spirit and scope of present invention, the scope of which is defined by the appended claims.

We claim:

1. An adjustable lavatory assembly comprising:

a box adapted to be attached to a wall, said box having an interior and a front panel window;

a drive mechanism locate inside the box member;

a platform member mounted on said box member and coupled directly to the drive mechanism via a chain, the platform member movable in a vertical direction along said box member, a movable screen member coupled at one end to and said chain and at the other end to said platform member;

a sink member coupled to the platform member;

wherein upon movement of said platform member and sink member along said box member in a vertical direction said screen member will cover said front panel window.

2. The lavatory assembly of claim 1 in which the drive mechanism is hydraulic.

3. The lavatory assembly of claim 1 in which the drive mechanism is electro-mechanical.

4. The lavatory assembly of claim 1 which further includes vertical guides positioned within the box member and adaptably engaged with the platform member for allowing vertical movement of the platform member.

5. The lavatory assembly of claim 4 in which further includes a service window coupled to the sink member.

6. The lavatory assembly of claim 5 which further includes a drain line coupled to the sink member.

7. The lavatory assembly of claim 6 in which the sink member further includes a faucet and service lines for hot and cold water.

8. The lavatory assembly of claim 7 in which the platform member includes a convex surface which engages a front panel surface which has a corresponding convex surface.

* * * * *